US008621804B2

(12) United States Patent
Houle

(10) Patent No.: US 8,621,804 B2
(45) Date of Patent: Jan. 7, 2014

(54) INSULATING WALL PANEL ASSEMBLY AND METHOD FOR MANUFACTURING SAME

(75) Inventor: André Houle, Laurier-Station (CA)

(73) Assignee: Materiaux Laurier Inc., Laurier-Station, Quebec (CA)

( * ) Notice: Subject to any disclaimer, the term of this patent is extended or adjusted under 35 U.S.C. 154(b) by 0 days.

(21) Appl. No.: 13/080,749

(22) Filed: Apr. 6, 2011

(65) Prior Publication Data

US 2011/0247286 A1 Oct. 13, 2011

Related U.S. Application Data

(60) Provisional application No. 61/322,342, filed on Apr. 9, 2010.

(51) Int. Cl.
*E04B 1/74* (2006.01)

(52) U.S. Cl.
USPC ..... 52/404.1

(58) Field of Classification Search
USPC ..... 52/404.1, 407.1, 407.4, 404.2, 408, 52/653.1, 745.05, 745.09
See application file for complete search history.

(56) References Cited

U.S. PATENT DOCUMENTS

| | | | | | |
|---|---|---|---|---|---|
| 4,488,390 | A * | 12/1984 | Mulford | 52/407.1 |
| 4,658,557 | A * | 4/1987 | Mulford | 52/407.1 |
| 4,674,253 | A * | 6/1987 | Young | 52/404.2 |
| 4,852,310 | A * | 8/1989 | Henley et al. | 52/91.3 |
| 5,297,369 | A * | 3/1994 | Dickinson | 52/281 |
| 5,377,470 | A * | 1/1995 | Hebinck | 52/405.1 |
| 5,765,330 | A * | 6/1998 | Richard | 52/309.13 |
| 5,953,883 | A * | 9/1999 | Ojala | 52/794.1 |
| 6,571,523 | B2 | 6/2003 | Chambers | |
| 8,151,539 | B2 * | 4/2012 | Grinsted | 52/745.1 |
| 2005/0005879 | A1 * | 1/2005 | Houle | 122/14.31 |
| 2007/0074474 | A1 | 4/2007 | Jannelle et al. | |
| 2007/0251468 | A1 * | 11/2007 | Houle | 122/19.2 |

* cited by examiner

*Primary Examiner* — Mark Wendell
*Assistant Examiner* — Keith Minter
(74) *Attorney, Agent, or Firm* — Price Heneveld LLP

(57) ABSTRACT

An insulating wall assembly, including a framework having opposite interior and exterior sides and including a plurality of vertical and horizontal support studs defining an inner spacing within the framework, a substantially rigid insulating panel mounted to the framework, and an insulating material extending in the inner spacing and juxtaposed to the rigid insulating panel. Each one of the vertical and horizontal support studs has an outer stud member having a thickness t1 and an inner stud member mounted inwardly to the outer stud member and having a thickness t2 thinner than the thickness t1. The substantially rigid insulating panel is supported peripherally by the inner stud members with the outer stud member circumscribing the rigid insulating panel.

27 Claims, 7 Drawing Sheets

INSULATING WALL PANEL ASSEMBLY AND METHOD FOR MANUFACTURING SAME

CROSS-REFERENCE TO RELATED APPLICATIONS

This application claims priority under 35 USC §119(e) of U.S. provisional patent application 61/322,342 filed Apr. 9, 2010, the specification of which is hereby incorporated by reference.

TECHNICAL FIELD OF THE INVENTION

The technical field relates to insulating wall panel assemblies and, more particularly, to an insulating wall panel assembly for walls pre-manufactured in factories for the construction of residential, commercial and industrial buildings. It also relates to structures such as buildings including same and to a method for manufacturing same.

BACKGROUND

Over the years, a major objective relating to building constructions has been to improve the insulation of exterior walls. Simultaneously, cheaper construction methods are sought, particularly through prefabricated wall panel assemblies which are constructed at a remote location and then delivered to the construction site for erection.

Standard walls are generally fabricated with insulating wool inside the walls. However, these standard walls include several thermal bridges which lower the degree of insulation, which is typically measured by the R-factor. Thermal bridges are points in the building envelope that allow direct heat conduction to occur. Since heat flows through the path of least resistance, thermal bridges can contribute to poor energy performance. A thermal bridge is created when materials create a continuous path across a temperature difference, in which the heat flow is not interrupted by thermal insulation. For instance, wall studs which extend through the wall structure from the exterior surface to the interior surface create thermal bridges.

Therefore, there is a need to lower the number of thermal bridges while obtaining a structural wall panel assembly with adequate mechanical and insulating properties at reasonable manufacturing costs.

BRIEF SUMMARY OF THE INVENTION

It is therefore an aim of the present invention to address the above mentioned issues.

According to a general aspect, there is provided an insulating wall assembly, comprising: a framework having opposite interior and exterior sides and including a plurality of vertical and horizontal support studs defining an inner spacing within the framework, each one of the vertical and horizontal support studs having an outer stud member having a thickness t1 and an inner stud member mounted inwardly to the outer stud member and having a thickness t2 thinner than the thickness t1; a substantially rigid insulating panel mounted to the framework, supported peripherally by the inner stud members with the outer stud member circumscribing the rigid insulating panel; and an insulating material extending in the inner spacing and juxtaposed to the rigid insulating panel.

According to a general aspect, there is provided a modular insulating wall panel, comprising: a sole plate having an outer sole member and an inner sole member mounted to and thinner than the outer sole member; a top plate spaced-apart from the sole plate and having an outer plate member and an inner plate member mounted to and thinner than the outer plate member; at least two vertical studs, spaced apart from one another and extending between the sole plate and the top plate, each one of the vertical studs having an outer stud member and an inner stud member mounted to and thinner than the outer stud member, the sole plate, the top plate and the at least two vertical studs defining a framework with an inner spacing; a substantially rigid insulating panel mounted to the framework, supported peripherally by the inner sole member, inner plate member, and inner stud members with the outer sole member, outer plate member, and outer stud members circumscribing the rigid insulating panel; and an insulating material extending in the inner spacing and juxtaposed to the rigid insulating panel.

According to a general aspect, there is provided an insulating wall assembly, comprising: a framework having opposite interior and exterior sides and including a plurality of vertical and horizontal support studs defining an inner spacing within the framework, at least two of the vertical and horizontal support studs having an outer stud member with a thickness t1 and an inner stud member with a thickness t2 thinner than the thickness t1 and mounted inwardly to the outer stud member; a substantially rigid insulating panel mounted to the framework, supported peripherally by the inner stud members with the outer stud member circumscribing the rigid insulating panel; and an insulating material layer extending in the inner spacing and superposed to the rigid insulating panel.

In an embodiment, the outer stud member exceeds the inner stud member on the exterior side and the interior side. A length of outer stud members exceeding on the interior side of the framework can be longer than a length of outer stud members exceeding on the exterior side of the framework.

In an embodiment, the substantially rigid insulating panel covers the inner stud members, close to the exterior side and the insulating material layer extends inwardly of the substantially rigid insulating panel.

In an embodiment, the framework is substantially rectangular and defined by two horizontal support studs and two vertical support studs extending between the two horizontal support studs and each one of the vertical and horizontal support studs comprises an outer stud member and an inner stud member secured inwardly to the respective outer stud member.

In an embodiment, the outer stud members extend inwardly past the insulating material layer.

The insulating wall assembly can further comprise a structural panel superposed inwardly to the insulating material layer and covering the inner stud members, the structural panel being supported by the inner stud members. The outer stud members can exceed the structural panel on the interior side of the framework.

In an embodiment, the substantially rigid insulating panel has a thickness which substantially corresponds to a length of the outer stud members exceeding the inner stud members on the exterior side and the insulating material layer has a thickness which substantially corresponds to a thickness of the inner stud members.

The insulating wall assembly can further comprise at least one of a tar paper layer, an air barrier material layer, and a vapor barrier material layer, the tar paper layer and an air barrier material layer being superposable to the substantially rigid insulating panel, on the exterior side of the framework and the vapor barrier material layer being superposable to the structural panel, on the interior side of the framework.

The insulating wall assembly can further comprise a plurality of inner laths mounted to the framework on the interior side, the interior end of the outer stud members and an exterior surface of the inner laths of the of the framework extend substantially in a same plane. The insulating wall assembly can further comprise stud members extending in the inner spacing of the framework.

In an embodiment, at least one of the support studs has an elongated groove defined therein filled with insulating material.

According to another general aspect, there is provided a method for erecting a wall section comprising interconnecting at least two of the insulating wall assemblies as detailed above in an adjacent configuration.

According to another general aspect, there is provided a building comprising at least two of the insulating wall assembly as detailed above.

According to a further general aspect, there is provided a modular insulating wall panel, comprising: a sole plate having an outer sole member and an inner sole member mounted to and narrower than the outer sole member; a top plate spaced-apart from the sole plate and having an outer plate member and an inner plate member mounted to and thinner than the outer plate member; at least two vertical studs, spaced apart from one another and extending between the sole plate and the top plate, each one of the vertical studs having an outer stud member and an inner stud member mounted to and thinner than the outer stud member, the sole plate, the top plate and the at least two vertical studs defining a framework with an inner spacing; a substantially rigid insulating panel mounted to the framework, supported peripherally by the inner sole member, the inner plate member and the inner stud members with the outer sole member, the outer plate member and the outer stud members circumscribing the rigid insulating panel; and an insulating material layer extending in the inner spacing and superposed to the rigid insulating panel.

In an embodiment, the outer sole plate, the outer plate member and the outer stud members exceed the inner sole plate, inner sole member, and the inner stud members on an exterior side and an opposed interior side. The substantially rigid insulating panel can cover the inner sole plate, inner sole member, and the inner stud members, close to the exterior side and the insulating material layer can extend inwardly of the substantially rigid insulating panel. The outer sole plate, the outer plate member and the outer stud members can extend inwardly past the insulating material layer. The modular insulating wall panel can further comprise a structural panel superposed inwardly to the insulating material layer and covering the inner sole plate, inner sole member, and the inner stud members. In an embodiment, the outer sole plate, the outer plate member and the outer stud members exceed the structural panel on the interior side of the framework.

In an embodiment, the substantially rigid insulating panel has a thickness which substantially corresponds to a length of the outer sole plate, the outer plate member and the outer stud members exceeding the inner sole plate, inner sole member, and the inner stud members on the exterior side of the framework.

According to still another general aspect, there is provided an insulating wall assembly, comprising: a framework having opposite interior and exterior sides and including a plurality of vertical and horizontal support studs defining an inner spacing within the framework, at least two of the vertical and horizontal support studs are at least two thickness support studs with an outer portion and an inner portion, the outer portion being thicker than the inner portion and being mounted outwardly to the inner portion; a substantially rigid insulating panel mounted to the framework, supported peripherally by the inner portion of the two thickness support studs with the outer portion of the two thickness support studs circumscribing the rigid insulating panel; and an insulating material layer extending in the inner spacing and superposed to the rigid insulating panel.

In an embodiment, the outer portion of the support studs exceeds the inner portion of the support studs on the exterior side and the interior side, and a length of outer portion exceeding the inner portion on the interior side of the framework is longer than a length of outer portion exceeding the inner portion on the exterior side of the framework.

In an embodiment, the substantially rigid insulating panel covers the inner portion of the support studs, close to the exterior side and the insulating material layer extends inwardly of the substantially rigid insulating panel.

In an embodiment, the framework is substantially rectangular and defined by two horizontal support studs and two vertical support studs extending between the two horizontal support studs and each one of the vertical and horizontal support studs comprises an outer portion and an inner portion extending inwardly to the respective outer portion.

In an embodiment, the outer portion of the support studs extends inwardly past the insulating material layer.

The insulating wall assembly can further comprise a structural panel superposed inwardly to the insulating material layer and covering the inner portion of the support studs, the structural panel being supported by the inner portion of the support studs. The outer portion of the support studs can exceed the structural panel on the interior side of the framework.

In an embodiment, the substantially rigid insulating panel has a thickness which substantially corresponds to a length of the outer portion of the support studs exceeding the inner portion of the support studs on the exterior side and the insulating material layer has a thickness which substantially corresponds to a thickness of the inner portion of the support studs.

In an embodiment, at least one of the support studs has an elongated groove defined therein filled with insulating material.

According to still another general aspect, there is provided a wall assembly comprising at least one support stud having at least one elongated groove extending therein and an insulating material insert inserted in the elongated groove.

In an embodiment, the at least one support stud comprises an outer stud member and an inner stud member juxtaposed inwardly to the outer stud member, the outer stud member having at least one of the elongated groove extending therethrough. The inner stud member can comprise at least one of the elongated groove in register with the elongated groove defined in the outer stud member. The outer stud member can comprise two members with the insulating material insert extending inbetween. The elongated groove of the outer stud member can extend from an inner face to an outer face of the outer stud member. The elongated groove of the outer stud member can extend partially through the outer stud member from an outer face thereof. The at least one elongated groove can extend along the longitudinal axis of the support stud.

According to still another general aspect, there is provided an insulating wall assembly, comprising: a framework including a plurality of support studs defining an inner spacing within the framework, at least one of the support studs having an outer stud member having a thickness t1 and an inner stud member mounted inwardly to the outer stud member and having a thickness t2 thinner than the thickness t1, the at least one of the support studs having at least one elongated groove defined therein filled with an insulating material insert.

In an embodiment, at least one of the elongated groove is defined in the outer stud member.

In an embodiment, the inner stud member comprises at least one of the elongated groove in register with the elongated groove defined in the outer stud member.

In an embodiment, the outer stud member comprises two members with the insulating material insert extending inbetween.

In an embodiment, the elongated groove of the outer stud member extends from an inner face to an outer face of the outer stud member.

In an embodiment, the elongated groove of the outer stud member extends partially through the outer stud member from an outer face thereof.

In an embodiment, the at least one elongated groove extends along the longitudinal axis of the support stud.

BRIEF DESCRIPTION OF THE DRAWINGS

It will be noted that throughout the appended drawings, like features are identified by like reference numerals.

DETAILED DESCRIPTION

Figures 1, 2, 3:
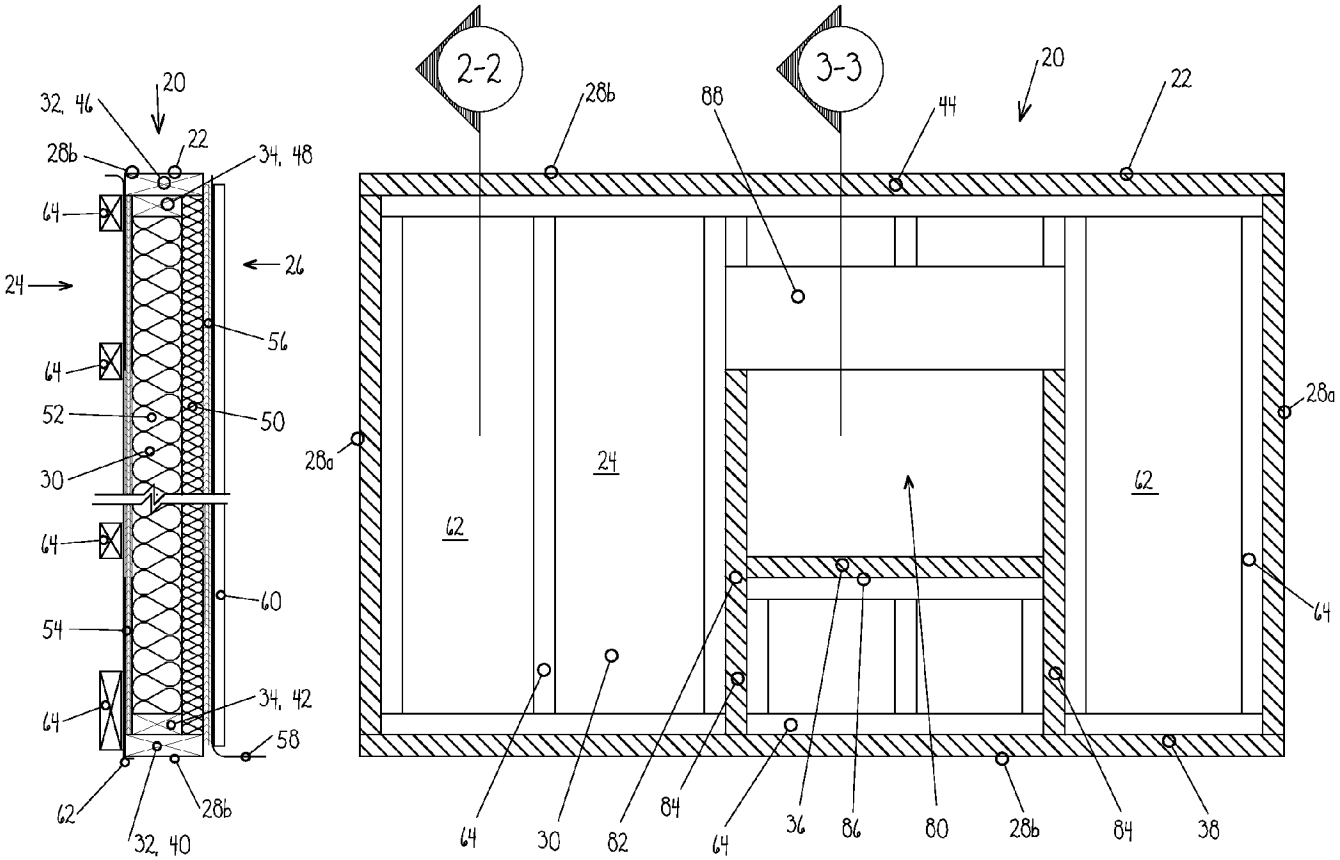
FIG. 1 is a front elevation view of an interior side of an insulating wall panel assembly in accordance with a first embodiment.
FIG. 2 is a sectional view, enlarged and fragmented, of the insulating wall panel assembly along section lines 2-2 of FIG. 1.
FIG. 3 is a sectional view, enlarged and fragmented, of the insulating wall panel assembly along section lines 3-3 of FIG. 1.
Figure 8:
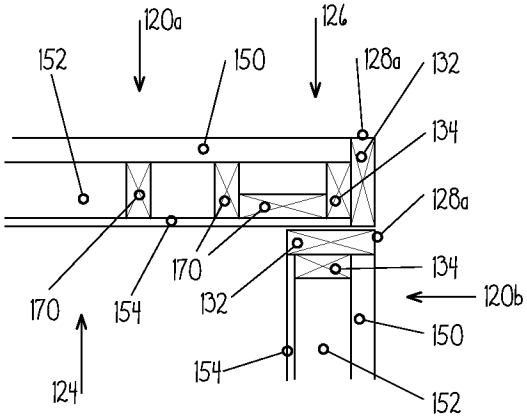
FIG. 8 is a cross-sectional view, fragmented, of two insulating wall panel assemblies shown in FIG. 5 adjacent to one another to define an exterior corner of a construction structure.

Referring now to the figures and, more particularly, to FIGS. 1 and 2, there is shown an insulating wall panel assembly 20 which includes a substantially rectangular outer framework 22 having opposite interior and exterior sides 24, 26.

The outer framework 22 includes a plurality of vertical and horizontal support studs 28*a*, 28*b* defining an inner spacing 30 within the outer framework 22. Each one of the vertical and horizontal support studs 28*a*, 28*b* has an outer stud member 32 and an inner stud member 34 juxtaposed inwardly to the outer stud member 32. The upper and lower horizontal support studs are often referred to as the top plate and the sole plate, as it will be described in more details below.

In the embodiment shown, the wall panel assembly 20 also includes an inner framework 82 including a plurality of vertically and horizontally extending support studs 84, 86 extending in the inner spacing 30 to rigidify the outer framework 22 and define a window opening framing 36. The structure of the window opening framing 36 will be described in more details below.

The horizontal support studs 28*b* can be divided into a sole plate 38 having an outer sole plate member 40 and an inner sole plate member 42 mounted to the outer sole plate member 40, inwardly of the outer framework 22, and a top plate 44 spaced-apart from the sole plate 38 and having an outer top plate member 46 and an inner top plate member 48 juxtaposed and secured to the outer top plate member 46, inwardly of the outer framework 22.

Similarly, the vertical support studs 28*a* are spaced apart from one another and extend between the sole plate 38 and the top plate 44. Each one of the vertical studs 28*a* has an outer stud member 32 and an inner stud member 34 juxtaposed and secured to the outer stud member 32.

Referring to FIG. 2, there is shown that the inner stud members 34, including the inner sole and top plate members 42, 48 and the vertical inner stud members, are thinner than their juxtaposed outer stud members 32, including the outer sole and top plate members 40, 46 and the vertical outer stud members. For instance, the outer stud members 32 have a thickness t1, thicker than a thickness t2 of the inner stud members 34. The thickness of the stud members 32, 34 is defined as the length of the stud members 32, 34 from the interior side 24 of the wall panel assembly 20 to the exterior side 26 of the wall panel assembly 20. Sections of the outer stud members 32 exceed the inner stud members 34 on the interior and exterior sides 24, 26. However, it is appreciated that in an alternative embodiment (not shown), the outer stud members 32 can exceed the inner stud members 34 on only one side, either the interior or the exterior sides 24, 26. In an alternative embodiment (not shown), the outer stud members 32 can exceed the inner stud members 34 on only one of the exterior side 26 and the interior side 24, the outer and inner stud members 32, 34 can be substantially flush with one another, i.e. they end in the same plane.

A rigid insulating panel 50 is mounted to the framework 22 and is supported peripherally by the inner stud members 34. The outer stud members 32 circumscribe the rigid insulating panel 50. In the embodiment shown, the rigid insulating panel 50 is mounted close to the exterior side 26 of the wall panel assembly 20. More particularly, its outer face is aligned with an end face of the outer stud members 32, on the exterior side 26, to define a substantially flat surface, i.e. they end in the same plane. The thickness of the rigid insulating panel 50 substantially corresponds to the length of the exterior exceeding section of the outer stud members 32.

The wall panel assembly 20 also includes an insulating material layer 52, which can be flexible, disposed in the inner spacing 30 and juxtaposed to the rigid insulating panel 50, inwardly thereof. The insulating material 52 is inserted between the inner stud members 34. The thickness of the insulating material layer 52 substantially corresponds to the thickness of the inner stud members 34. The insulating material layer 52 and the inner stud members 34 lie in the same plane.

In the embodiment shown and as mentioned above, the outer stud members 32 exceed the inner stud members 34 also on the interior side 24. A structural panel 54 is mounted to the outer framework 22 on the interior side 24. The structural panel 54 is peripherally supported by the inner stud members 34 and circumscribed by the outer stud members 32. In the embodiment shown, the structural panel 54 is close to the interior side 24 of the wall panel assembly 20. More particularly, its outer surface is aligned with an end face of the outer stud members 32, on the interior side 24, to define a substantially flat surface, i.e. they end in the same plane. The thickness of the structural panel 54 substantially corresponds to the length of the interior exceeding section of the outer stud members 32.

In the embodiment shown, the exterior side 26 of the wall panel assembly 20 includes a tar paper 56. The tar paper 56 is juxtaposed to the rigid insulating panel 50 and the outer stud members 32, outwardly of the inner spacing 30. An air barrier material layer 58 extends over the tar paper 56, outwardly of the inner spacing 30. It covers the tar paper 56. Finally, the wall panel assembly 20 includes outer laths 60 juxtaposed to the air barrier material layer 58, outwardly of the inner spacing 30. In the embodiment shown, the outer laths 60 extend vertically. However, in an alternative embodiment (not shown), they can extend in a substantially horizontal configuration.

In the embodiment shown, the interior side 24 of the wall panel assembly 20 includes a vapor barrier material layer 62 juxtaposed to the structural panel 54. The vapor barrier material layer 62 extends over the structural panel 54. It covers the structural panel 54 and the outer stud members 32. The wall panel assembly 20 further includes inner laths 64 juxtaposed to the vapor barrier material layer 62. In the embodiment shown, the inner laths 64 extend horizontally. However, in an alternative embodiment (not shown), the inner laths 64 can extend in a substantially vertical configuration.

Figure 4:
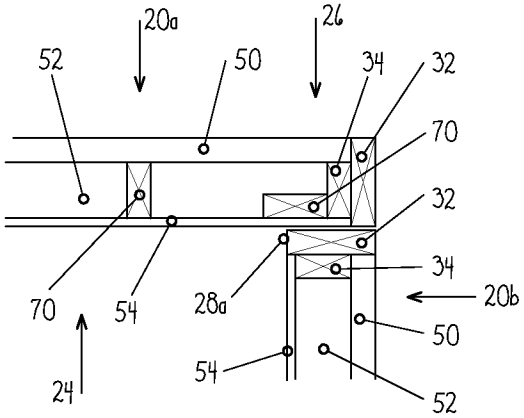
FIG. 4 is a cross-sectional view, fragmented, of two insulating wall panel assemblies shown in FIG. 1 adjacent to one another to define an exterior corner of a construction structure.
Figure 7:
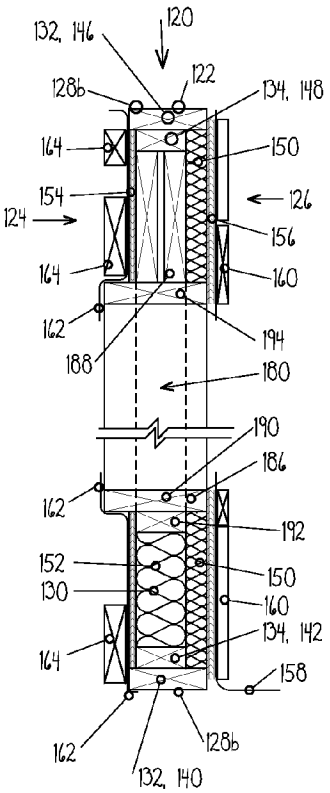
FIG. 7 is a sectional view, enlarged and fragmented, of the insulating wall panel assembly along section lines 7-7 of FIG. 5.
Figure 5:
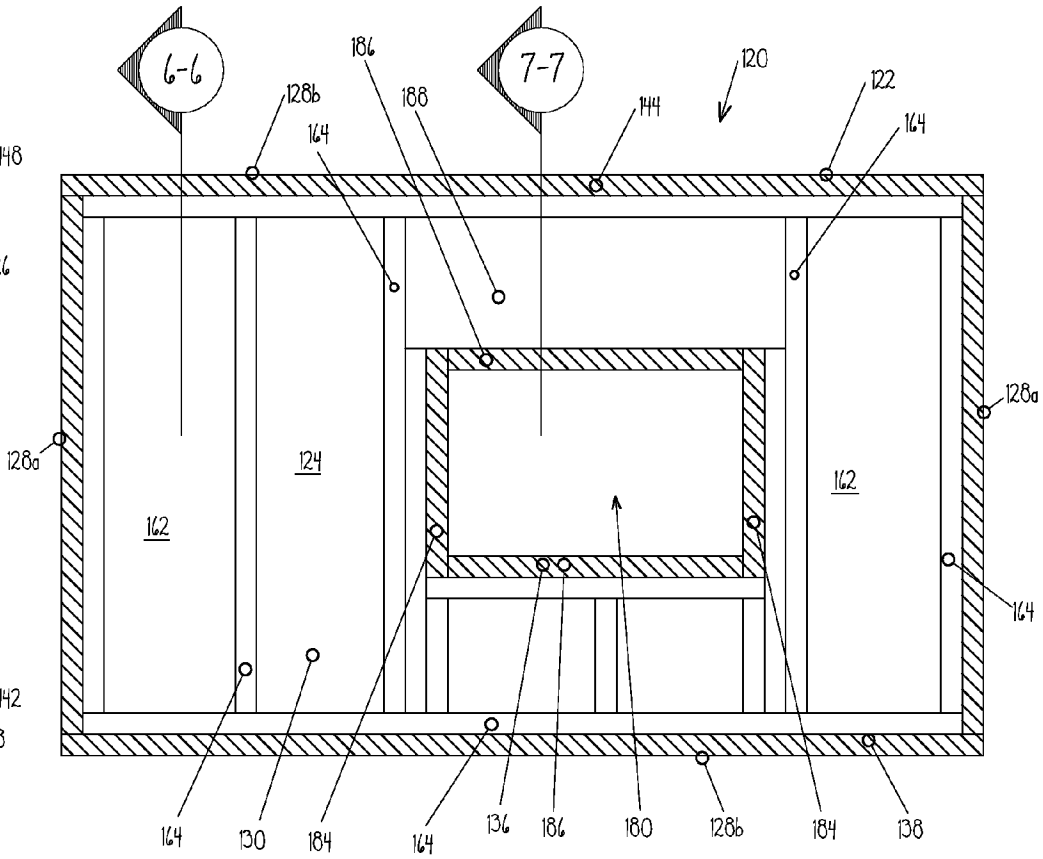
FIG. 5 is a front elevation view of an interior side of an insulating wall panel assembly in accordance with a second embodiment, wherein the insulating wall panel assembly has outer studs of different thicknesses.
Figure 6:
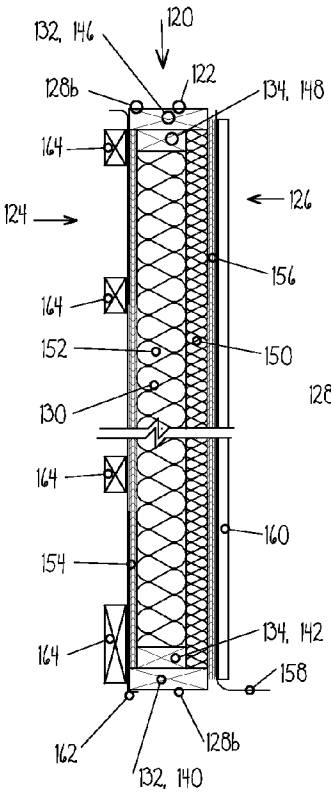
FIG. 6 is a sectional view, enlarged and fragmented, of the insulating wall panel assembly along section lines 6-6 of FIG. 5.
Figure 11:
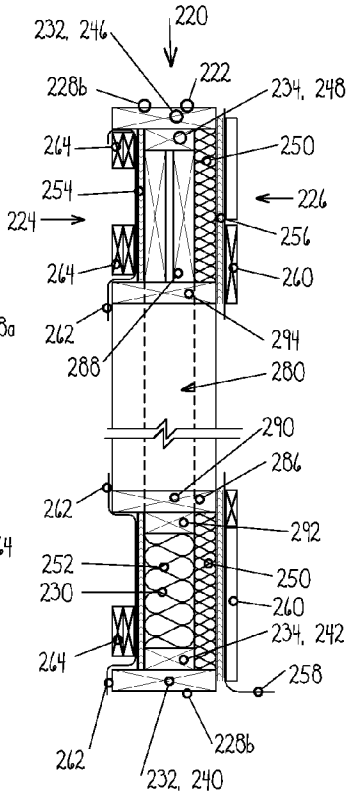
FIG. 11 is a sectional view, enlarged and fragmented, of the insulating wall panel assembly along section lines 11-11 of FIG. 10.
Figure 9:
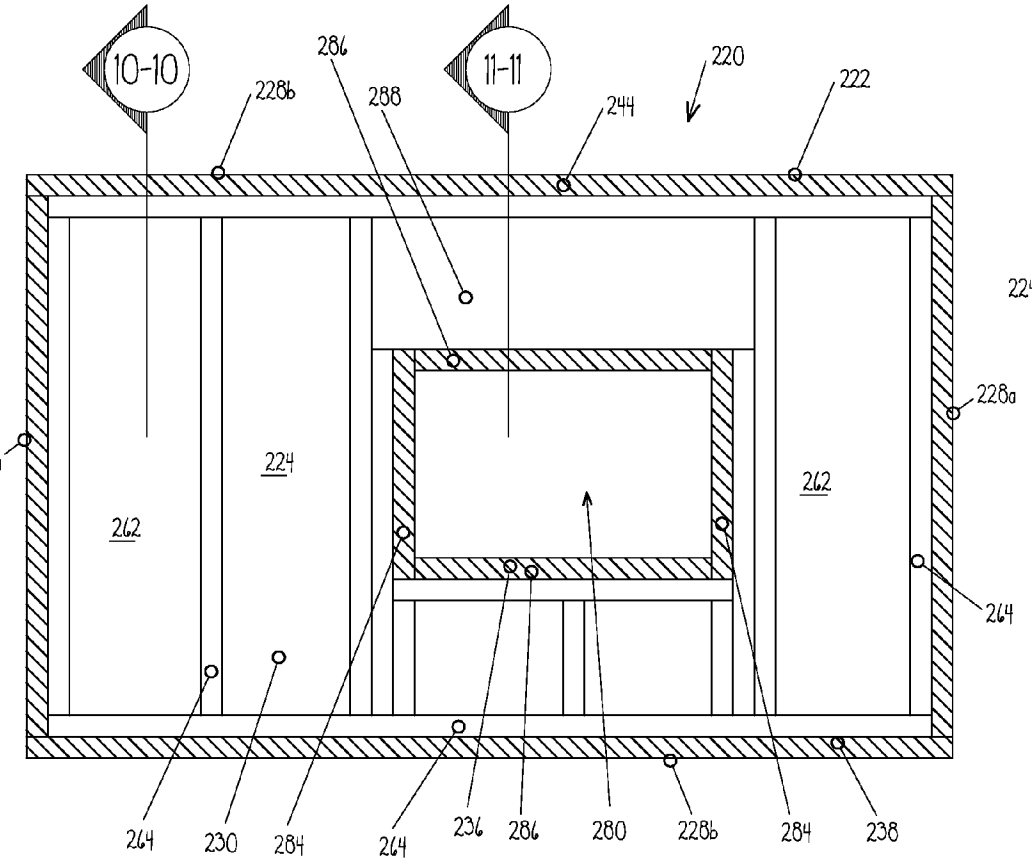
FIG. 9 is a front elevation view of an interior side of an insulating wall panel assembly in accordance with a third embodiment with thicker outer studs.

Referring now to FIG. 4, there is shown sections of two wall panel assemblies 20*a*, 20*b* in an adjacent relationship and configured to define an exterior corner of a construction structure. There is shown that reinforcing studs 70 can extend in the inner spacing 30 to reinforce the wall panel assembly or to provide nailing or screwing support. In the embodiment shown, both adjacent wall panel assemblies 20*a*, 20*b* have a two thickness stud member structure. One skilled in the art will appreciate that in an alternative embodiment (not shown), only one of the juxtaposed wall panel assemblies can be a two thickness stud member construction. In the embodiment shown, one reinforcing stud 70 extends between the rigid insulating panel 50 and the structural panel 54. Another reinforcing stud 70 has one end juxtaposed to the outer stud member 32 and extends parallel and superposed to the structural panel 54.

In an alternative embodiment (not shown), the wall panel assembly 20*a* can include more than one reinforcing stud 70 extending between the rigid insulating panel 50 and the structural panel 54. It can include a reinforcing stud having the thickness of the outer stud member 32 but spaced-apart therefrom. The position of this reinforcing stud can substantially correspond to the interior side of the wall panel assembly 20*b*. A reinforcing stud 70 extending between the rigid insulating panel 50 and the structural panel 54 can be positioned between the longer reinforcing stud and the outer stud member 32.

The wall panel assembly 20 shown in FIGS. 1 and 3 includes a window opening 80. An inner framework 82 surrounds the window opening 80. Most components of the inner framework 82 are similar to the one described above and rigidify the wall panel assembly 20. The window framing 36 includes two spaced-apart vertically-extending support studs 84 extending upwardly from the sole plate 38, one horizontally-extending support stud 86 connecting together both vertically-extending support studs 84 and positioned below the window opening 80, and one lintel 88 extending above the window opening 80 and both vertically-extending support studs 84.

Each one of the vertically and horizontally extending support studs 84, 86 includes an outer stud member 90 and an adjacent inner stud member 92. The outer stud members 90 define the window opening 80 while the inner stud members 92 are located inwardly in the inner spacing 30, spaced-apart from the window opening 80 by the outer stud members 90. As for the framework 22, the inner stud members 92 have a reduced thickness in comparison with the outer stud members 90 and support the rigid insulating panel 50.

As shown in FIG. 3, the insulating panel 50 extends over the lintel 88 to reduce the thermal bridges of the wall panel assembly 20.

It is appreciated that a similar inner framework 82 can be used for a door framing (not shown).

It is appreciated that the design of the inner framework 82 and/or of the window framing 36 can differ from the one described above and shown in the figures. Furthermore, the design of the inner framework 82 and/or of the window framing 36 can differ from the design of the outer framework 22.

Referring to FIGS. 5 to 8, there is shown an alternative embodiment of the wall panel assembly 20 wherein the features are numbered with reference numerals in the 100 series which correspond to the reference numerals of the previous embodiment. The wall panel assembly 120 is similar to the wall panel assembly 20 described above in reference to FIGS. 1 to 4. The configuration of the interior and exterior sides 124, 126 close to the outer framework 122 is substantially similar to the one described above in reference to FIGS. 1 to 4 and will not be described further.

However, on the opposite of the above described embodiment in reference to FIGS. 1 to 4, the design of the inner framework 182 is different. More particularly, the outer stud members 90 of the vertical and horizontal support studs 84, 86 extending in the inner spacing 130 to rigidify the framework 122 and define the window framing 136 are thicker than the outer stud members 132 defining the outer framework 122.

In the embodiment shown, the outer stud members 190 of the window framing 136 have a thickness t3 thicker than the outer studs 132 (thickness t1). For example and without being limitative, the outer stud members 132 of the outer framework 122 are 2×6's studs, the inner stud members 192, 134 of the outer framework 122 and the window framing 136 are 2×4's studs, and the outer stud members 190 of the window framing 36 are 2×7's studs. The thicker stud members 190 for the window or door framing can be used directly as nailing support. No additional laths are necessary since they can directly support the outer material, if any.

More particularly, on the interior side 124 of the wall panel assembly 120, the outer stud members 190 exceed the structural panel 154 and the vapor barrier material layer 162 juxtaposed to the structural panel 154. The end of the outer stud members 190, on the interior side 124, is aligned with an exterior face of the inner laths 164 mounted to the wall panel assembly 120, i.e. their ends extend in the same plane. The vapor barrier material layer 162 extends over the inner surface of outer stud members 190 and under the inner laths 164.

As opposed to the window framing 36, the window framing 136 includes two spaced-apart vertically-extending support studs 184 surrounding the window aperture 180 and two spaced-apart horizontally-extending support studs 186, 194 connecting together both vertically-extending support studs 184. The horizontally-extending support studs 186, 194 are positioned respectively below and above the window opening 180, between the vertically-extending support studs 184. The lintel 188 extends from the upper horizontally-extending support studs 194 to the top plate 144. However, only the lower horizontally-extending support stud 186 and both vertically-extending support studs 184 include an outer stud member 190 and an adjacent inner stud member 192 narrower than the outer stud member 190 and supporting the rigid insulating panel 150. The upper horizontally-extending support stud 194 includes only one component supporting directly the lintel 188. As for the above-described embodiment, the insulating panel 150 extends over the lintel 188 to reduce the thermal bridges of the wall panel assembly 120.

Referring to FIGS. 9 to 12, there is shown another alternative embodiment of the wall panel assemblies 20, 120 wherein the features are numbered with reference numerals in the 200 series which correspond to the reference numerals of the previous embodiments. The wall panel assembly 220 is similar to the wall panel assemblies 20, 220 described above in reference to FIGS. 1 to 8. However, the outer stud members 232 of outer framework 222 and the window framing 236 are longer than in the previously described embodiments and extend past the structural panel 254 on the interior side 224 of the wall panel assembly 220.

Figure 10:
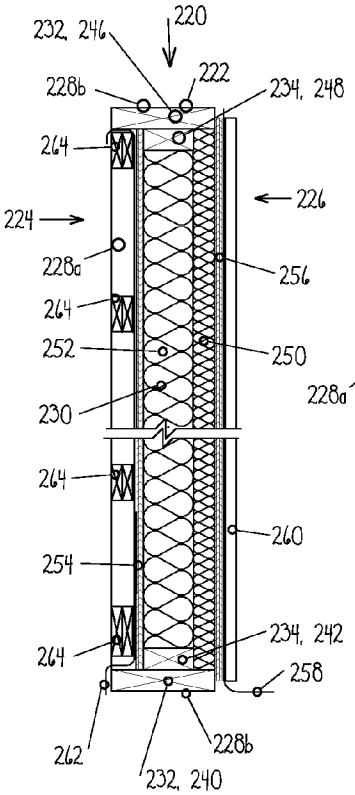
FIG. 10 is a sectional view, enlarged and fragmented, of the insulating wall panel assembly along section lines 10-10 of FIG. 9.

Referring to FIG. 10, there is shown that the inner stud members 234 are thinner than their juxtaposed outer stud members 232. The outer stud members 232 exceed the inner stud members 234 on the interior and exterior sides 224, 226 of the wall panel assembly 220. The configuration of the exterior side 226 is substantially similar to the one described above in reference to FIGS. 1 to 4 and will not be described further.

On the interior side 224 of the wall panel assembly 220, the outer stud members 232 exceed the structural panel 254 and the vapor barrier material layer 262 juxtaposed to the structural panel 254. The end of outer stud members 232, on the interior side 224, is aligned with an exterior surface of the inner laths 264 mounted to the wall panel assembly 220, i.e. they are substantially flush or their ends are in the same plane. The vapor barrier material layer 262 extends over the interior face of outer stud members 232 and under the inner laths 264.

The window framing 236 is substantially similar to the window framing 136 and will not be described in further details below.

Figure 12:
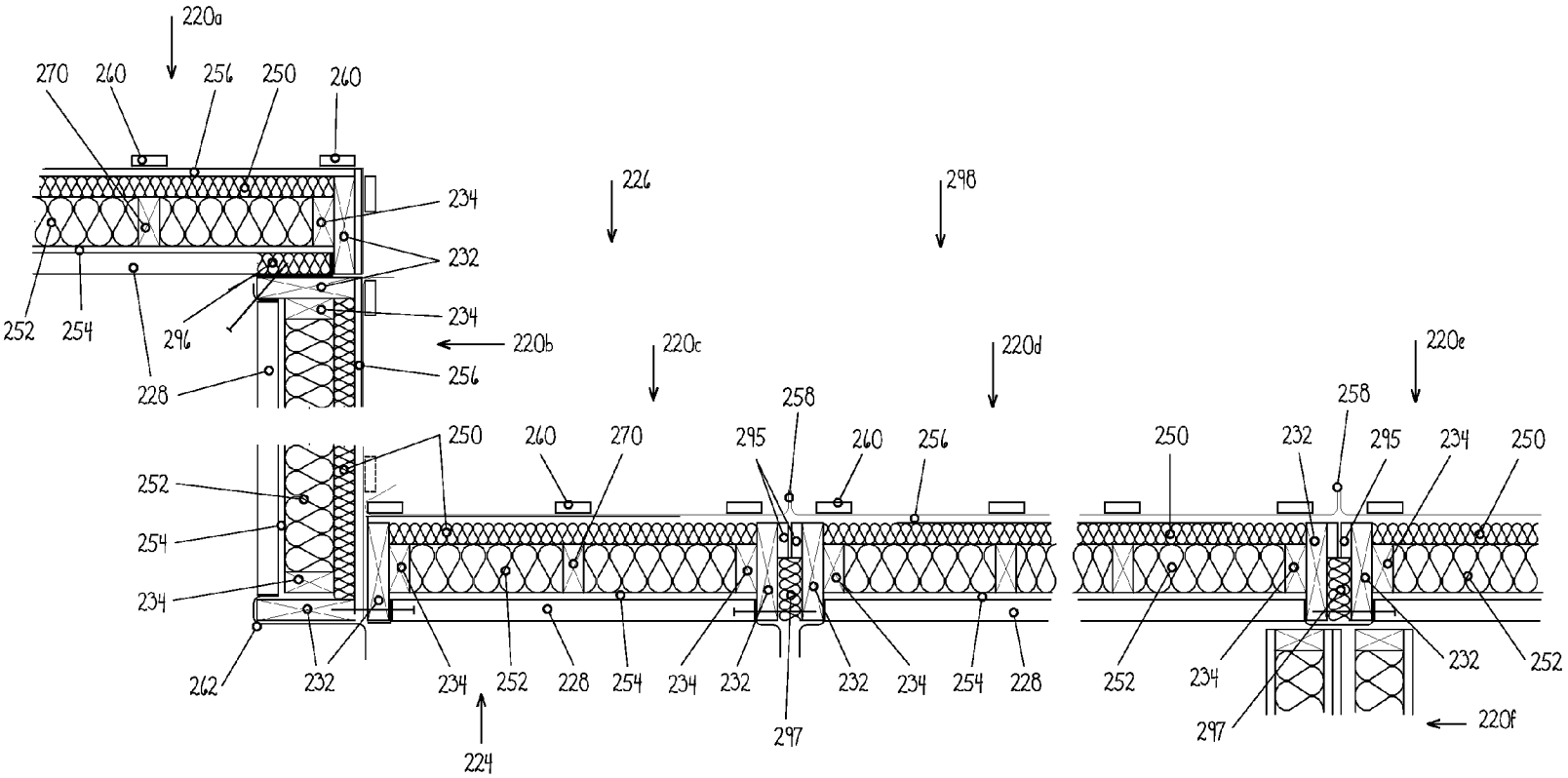
FIG. 12 is a cross-sectional view, fragmented, of several insulating wall panel assemblies shown in FIG. 9 adjacent to one another to define a construction structure with exterior and interior corners.

Referring now to FIG. 12, there is shown sections of juxtaposed wall panel assemblies 220*a*, 220*b*, 220*c*, 220*d*, 220*e*, 220*f* in an adjacent relationship and configured to define a construction structure 298 including an exterior corner 274 and an interior corner 276. As for the above described embodiments, reinforcing studs 270 can extend in the inner spacing 230 to rigidify the wall panel assemblies 220 and provide nailing or screwing support.

When two wall panel assemblies 220*a*, 220*b* are juxtaposed to define an exterior corner 274, insulating material 296 can be inserted in a spacing defined between an outer stud member 232 of a wall assembly 220*b* and an interior side 224 of the adjacent wall assembly 220*a*, between the outer surface of the first outer stud member 232 and the structural panel 254 and the covering vapor barrier material layer 262 of the adjacent wall assembly 220*a* for further increasing the insulation of the wall assembly structure 298.

When two wall panel assemblies 220*c*, 220*d*, 220*e* are juxtaposed side-by-side, in a contiguous relationship, to define a continuous and substantially straight construction structure, laths 295 can be mounted on each outer stud members 232, close to the exterior side of the wall panel assemblies 220*c*, 220*d*, 220*e* and insulating material 297 can be inserted in a spacing defined between the contiguous wall assemblies 220*c*, 220*d*, 220*e*. In an alternative embodiment (not shown), the laths 295 can be replaced by an OSB panel or any other structural material.

In an alternative exterior corner (not shown), the interior side of the wall panel assembly 220*b* can be juxtaposed to the outer stud of the wall panel assembly 220*a*. In an alternative interior corner (not shown), the exterior side of the wall panel assembly 220*c* is juxtaposed to the outer stud of the wall panel assembly 220*b*. The air barrier material layer 258 can extend on both exterior sides of juxtaposed wall panel assemblies 220. The lateral walls of the outer stud member 232 in an exterior corner 274 can be covered by the outer layer, including the air barrier material layer 258 and/or the tar paper 256. Similarly, the lateral walls of the outer stud in an interior corner 276 can be covered by the inner layer, including the vapor barrier material layer 262.

The wall assembly can be adapted for non-right angle corners (not shown) through outwardly mounted studs, i.e. stud mounted to the outer stud member 232 of a wall panel assembly 220.

The stud members 32, 34, 132, 134, 232, 234 can be made of any appropriate structural materials. For instance and without being limitative, the stud members can be made of wood, metal, concrete, polymers, composite materials such as engineering wood, and the like. In a non-limitative embodiment, they have a substantially rectangular cross-section.

For instance and without being limitative, the outer stud members 32 can be studs of any size, e.g. 2×4's, 2×6's, 2×7's, 2×8's or any other suitably sized members. Similarly the inner stud members 34 can be studs of any size with a reduced thickness in comparison with the outer stud members 32. For example and without being limitative, the outer stud members 32 can be 2×6's studs and the inner stud members 34 can be 2×4's studs. As one skilled in the art will appreciate, the true measurement of the stud members can slightly differ from its denomination. For example, a 2×4 is actually approximately 1.5 inches by 3.5 inches.

The structural member including an inner stud and an outer stud can be single piece. In an embodiment, stud members can be mounted outwardly to the outer stud members. A material layer such as and without being limitative an insulating material layer or an OSB panel can be interposed between the outer and the inner stud members.

The insulating panel and the insulating material layer can be multi-components with studs or structural members extending between the adjacent components.

The rigid insulating material can be any material having insulating properties which can be provided in a substantially rigid panel shape. For instance and without being limitative, it can include expanded and extruded polystyrene, polyurethane, polyisocyanurate, other plastic foam, mineral wool fiber panels including fiberglass, rock and slag wool panels, and the like. For instance, CavityRock® panels can be used. In a non-limitative embodiment, the thickness of the rigid insulating panel 50 can vary between ½ and 3 inches and, in another non-limitative embodiment, the thickness of the rigid insulating panel 50 can vary between 1 and 2 inches. In a particular embodiment, the thickness of the rigid insulating panel 50 is about 1½ inches.

The insulating material layer can include any flexible material having insulating properties. For instance and without being limitative, it can include mineral wool, mineral fibres or man-made mineral fibres made from natural or synthetic minerals or metal oxides. Synthetic materials such as fibreglass (glass wool), ceramic fibres, rock or stone wool, and the like can be used. For instance, Roxul® mineral wool can be used. In a non-limitative embodiment, the thickness of the flexible insulating material layer can vary between 2 and 10 inches and, in another non-limitative embodiment, the thickness of the flexible insulating material layer can vary between 3 and 6 inches. In a particular embodiment, the thickness of the flexible insulating material layer is about 3½ inches. It is appreciated that the insulating material layer juxtaposed to the substantially rigid insulating panel can also be substantially rigid. For instance and without being limitative, blown or pulverized insulating materials or anyone of the materials used for the rigid insulating material panel can be used.

The insulating material layer and panel can have insulating properties for thermal, acoustic, fire, and impact purposes, and the term also applies to thermal insulation, acoustic insulation, fire insulation, impact insulation, or combination thereof.

The air barrier material layer 58 controls air leakage in and out of the building envelope. Air barrier products may take several forms such as, without being limitative, mechanically-attached membranes, also known as housewraps, usually a polyethylene-fiber or spun-bonded polyolefin product that allows vapor transmission, such as Tyvek® or Typar®, micro-perforated, cross-lapped films, films laminated to spunbond nonwovens, films laminated or coated to polypropylene wovens.

The structural panel 54 rigidifies the wall assembly 20. It can be made of substantially rigid material such as and without being limitative, plywood, oriented strandboard (OSB), cardboard, a polyisocyanate panel, any other rigid insulating panel, etc. In a non-limitative embodiment, the thickness of the structural panel 54 can vary between ¼ and 3 inches and, in another non-limitative embodiment, the thickness of the structural panel 54 can vary between ¼ and 1 inch. In a particular embodiment, the thickness of the structural panel 54 is about ½ inch. It is appreciated that the structural panel can be replaced by any appropriate bracing structure.

The inner and outer laths are relatively thin, narrow strips of some straight-grained wood or other material, including, without being limitative, metal and gypsum. In an embodiment, the inner laths can be double laths, i.e. two laths superposed to one another, with the inner one of the double laths defining discontinuities (or spacing) defined therein wherein wires, such as electrical wires, can be inserted.

The vapor barrier material layer provides resistance to the diffusion of moisture through the wall assemblies. It can be made of several materials such as and without being limitative, plastic, metallic foil sheets or combination thereof. For instance, Flexotherm™ membranes made of a polyethylene film laminated on a 99% pure aluminum foil can be used.

The air barrier material layer, the tar panel, and the vapor barrier material layer can extend continuously from one panel assembly to an adjacent panel assembly.

It is appreciated that the support studs, the rigid insulating panel, the insulating material layer, the structural panel, the tar paper, the air and vapor barrier material layers, the inner laths, and the outer laths can be single piece along one of the wall assemblies or they can be multi-pieces, i.e. they can include several juxtaposed pieces.

It is appreciated that in an alternative embodiment (not shown), the insulating wall assembly can include additional material layers or supporting structure or it can exclude one or several of the materials included in the above described embodiments. For instance and without being limitative, the insulating wall assembly can be free of at least one of tar paper, air barrier layer, outer laths, structural panel, vapor barrier layer and inner laths. Furthermore, the configuration and design of the various superposed layers or materials can vary from the ones described above. For instance and without being limitative, the interior side of the wall assembly can be rigidified with another material than the structural panel such as braces, or the position of the inner or outer laths can vary from the one shown.

Furthermore, a first set of components or parts of the wall assembly can be assembled at a remote location and another set of components or parts can be assembled on the construction site. For instance and without being limitative, the outer and inner laths can be mounted directly on the construction site or they can be mounted to the wall panel assembly at a remote location.

Exterior materials (not shown) can be fastened by nails or screws to the exterior surface and, more particularly, to the outer laths 60. Wallboards or other well known materials (not shown) can be applied to the interior surface by fastening with nails or screws to the inner laths 64.

Figure 13:
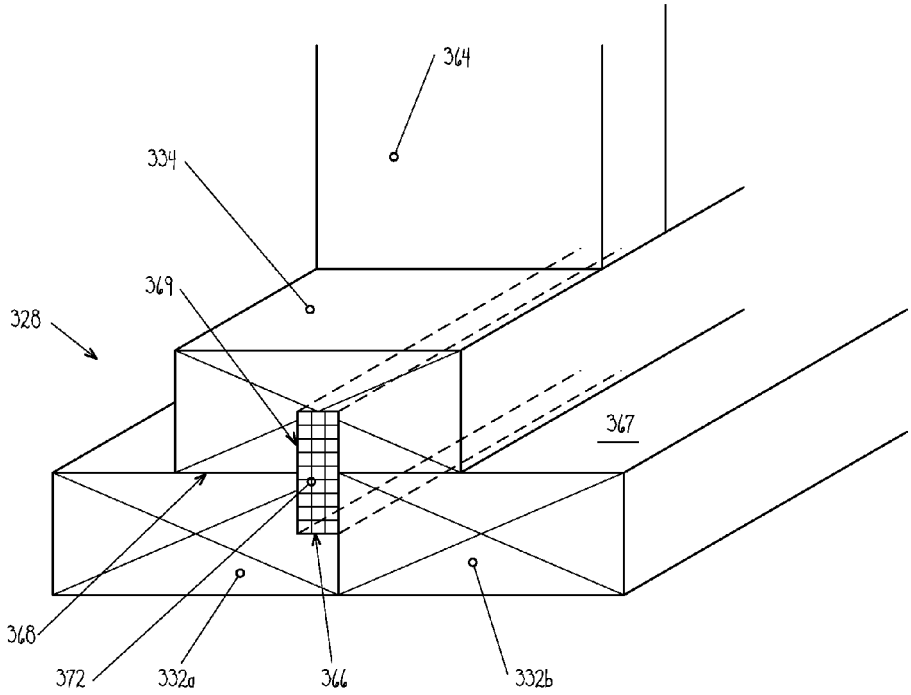
FIG. 13 is a perspective cross-sectional view of a support stud for the insulating wall panel assembly in accordance with an embodiment including an inner stud member and an outer stud member with an insulating material extending partially therein.

Referring to FIGS. 13 to 16, embodiments of the support studs will be described wherein the support studs include insulating material inserts to reduce the thermal bridges of the wall panel assembly 20, 120, 220. FIG. 13 shows a support stud 328 including an outer stud member 332 and an inner stud member 334 juxtaposed inwardly to the outer stud member 332. The outer stud member 332 has an elongated groove 366 defined therein from an inner face 367. The elongated groove 366 extends substantially parallel to the longitudinal axis of the outer stud member 232. In the embodiment shown, the outer stud member 332 includes two juxtaposed and adjacent members 332*a*, 332*b* with only the outer stud member 332*a* including a discontinuity in its inner face 367. The juxtaposition of the two outer stud members 332*a*, 332*b* define the elongated groove 366. One skilled in the art will appreciate that in an alternative embodiment (not shown), the outer stud member 332 can be single piece with the elongated groove 366 extending longitudinally therein. In another alternative embodiment (not shown), the outer stud member 332 can include two juxtaposed and adjacent members with both members having a discontinuity in their inner faces. The juxtaposition of the two indented outer stud members define the elongated groove.

The corresponding inner stud member 334 also includes an elongated groove 369 defined therein on an outer face 368, juxtaposed to the inner face 367 of the outer stud member 332. The elongated groove 369 extends substantially parallel to the longitudinal axis of the inner stud member 334 and is in registry with the elongated groove 366 defined in the inner face 367 of the outer stud member 332. In the embodiment shown, the inner stud member 334 is single piece and the elongated groove 369 is defined about centrally therein. However, in an alternative embodiment (not shown), the inner stud member 334 can include two juxtaposed and adjacent members with one or both members having a discontinuity in their outer faces and defining the elongated groove.

An insulating material insert 372 is inserted in the elongated grooves 366*a*, 366*b* defined in the outer and inner stud members 332, 334. The insulating material insert 372 extends continuously from the elongated groove 366 defined in the outer stud member 332 to the elongated groove 369 defined in the inner stud member 334. The insulating material insert 372 reduces the thermal bridge of the support stud 328.

Figure 14:
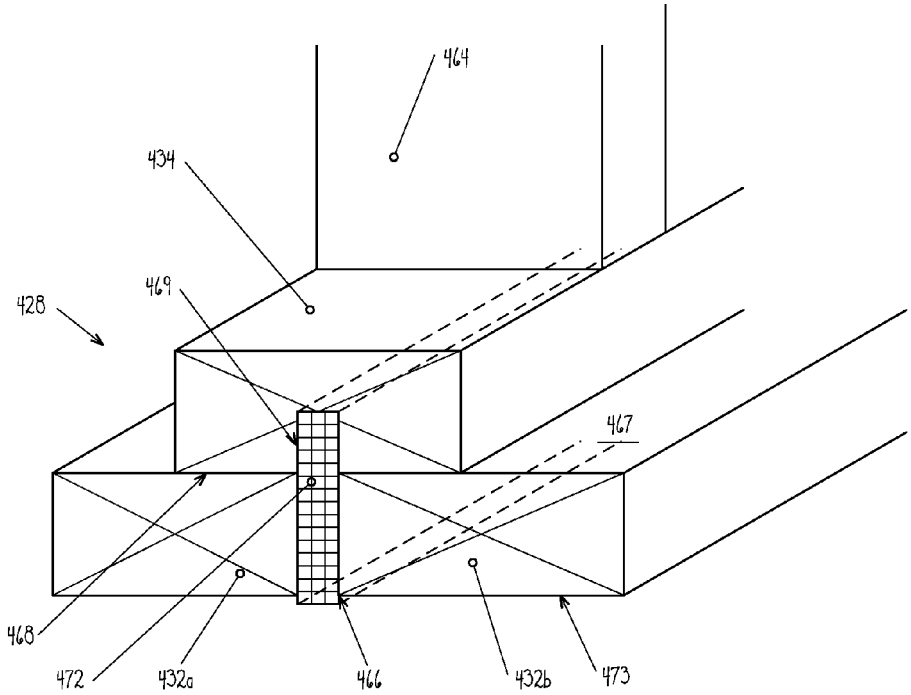
FIG. 14 is a perspective cross-sectional view of the support stud for the insulating wall panel assembly in accordance with another embodiment wherein the inner stud member and the outer stud member include the insulating material with the insulating material extending throughout the outer stud member.

Referring to FIG. 14, there is shown an alternative embodiment of the support stud 328 wherein the features are numbered with reference numerals in the 400 series which correspond to the reference numerals of the previous embodiment. In the embodiment of FIG. 14, the insulating material insert 472 extends throughout the outer stud member 432, i.e. from the inner face 467 to the outer face 473. The insulating material insert 472 even protrudes outwardly from the outer face 473. As in the embodiment shown in FIG. 13, the outer stud member 432 includes two members 432*a*, 432*b*. The insulating material insert 472 extends in-between the two outer stud member 432*a*, 432*b*. The elongated groove 472 defined by the two outer stud member 432*a*, 432*b* is in register with the elongated groove 469 defined in the inner stud member 434.

Figure 15:
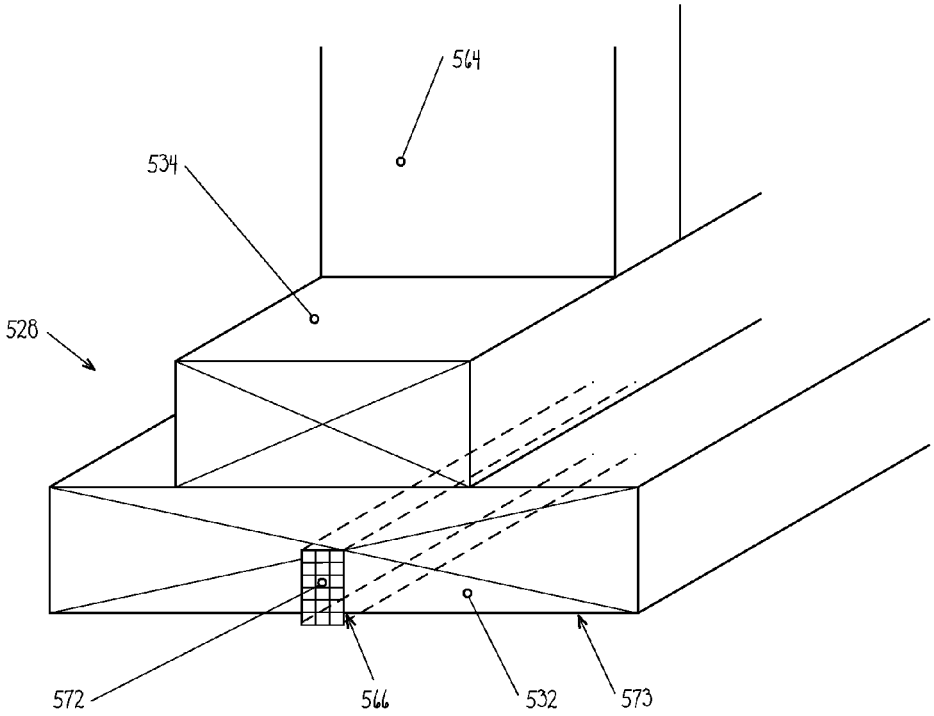
FIG. 15 is a perspective cross-sectional view of the support stud for the insulating wall panel assembly in accordance with another embodiment wherein the outer stud member includes the insulating material with the insulating material extending partially therethrough.

Referring to FIG. 15, there is shown an alternative embodiment of the support studs 328, 428 wherein the features are numbered with reference numerals in the 500 series which correspond to the reference numerals of the previous embodiment. In the embodiment shown in FIG. 15, solely the outer stud member 532 includes an insulating material insert 572. The outer stud member 532 is single piece and has an elongated groove 566 extending therein from the outer face 573. The elongated groove 566 extends substantially parallel to the longitudinal axis of the outer stud member 532. In an alternative embodiment (not shown), the outer stud member 532 can include two juxtaposed and adjacent members with one or both outer stud members including a discontinuity in their outer face 573 with the juxtaposition of the two outer stud members defining the elongated groove 566. The insulating material insert 572 extends partially throughout the outer stud member 532. One skilled in the art will appreciate that, in an alternative embodiment (not shown), the elongated groove can be defined in the inner face of the outer stud member 532. In an alternative embodiment (not shown), the elongated groove can extend throughout the outer stud member, i.e. from the inner face to the outer face.

Figure 16:
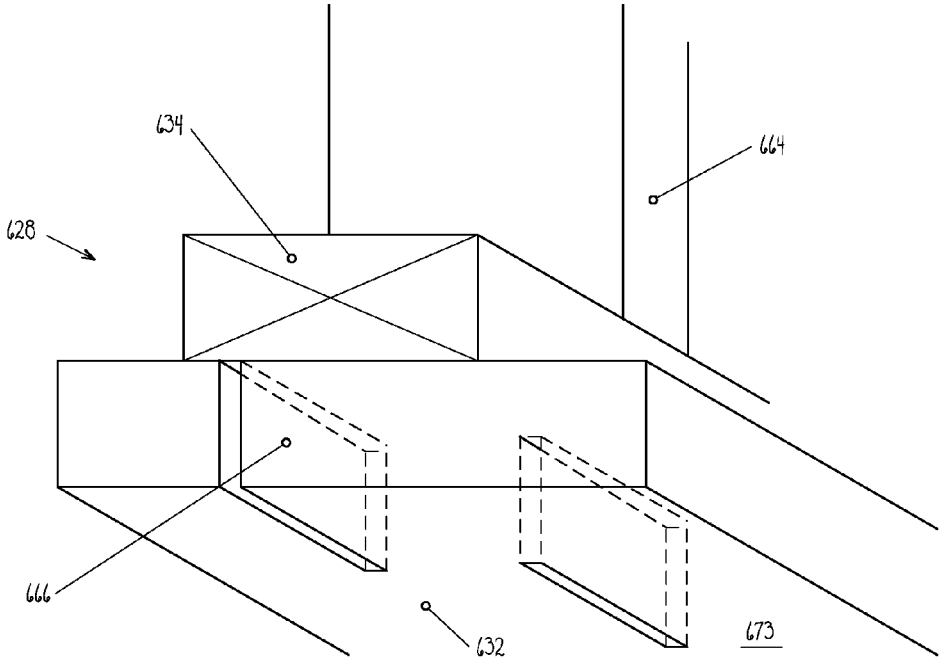
FIG. 16 is a perspective cross-sectional view of the support stud for the insulating wall panel assembly in accordance with another embodiment wherein the outer stud member includes a plurality of discontinuous elongated apertures.

Referring to FIG. 16, there is shown an alternative embodiment of the support studs 328, 428, 528 wherein the features are numbered with reference numerals in the 600 series which correspond to the reference numerals of the previous embodiment. In the embodiment shown in FIG. 16, the outer stud member 632 includes a plurality of spaced-apart elongated grooves. The outer stud member 632 is single piece. The elongated grooves 666 are oriented along the longitudinal axis of the outer stud member 632. Two rows of elongated grooves 666 spaced-apart from one another are defined in the outer stud member 632. The ends of the elongated grooves 666 defined in a first row overlap the ends of the elongated grooves 666 defined in the other row, i.e. an elongated groove defined in the second row begins at a position located rearwardly of the end of an elongated groove defined in the first row in a manner such that the outer stud member 632 includes two overlapping elongated groove sections. In the embodiment shown, the elongated grooves 666 extend throughout the outer stud member 632, i.e. from the inner face 667 to the outer face 673. However, in an alternative embodiment, they can extend partially through the outer stud member 632.

One skilled in the art will appreciate that the vertical stud members and/or the horizontal stud members can include the above-described insulating material inserts.

The insulating material can be any suitable insulating material including the above-detailed insulating material for the insulting panel and the insulating material layer.

Several alternative embodiments and examples have been described and illustrated herein. The embodiments of the invention described above are intended to be exemplary only. A person of ordinary skill in the art would appreciate the features of the individual embodiments, and the possible combinations and variations of the components. A person of ordinary skill in the art would further appreciate that any of the embodiments could be provided in any combination with the other embodiments disclosed herein. It is understood that the invention may be embodied in other specific forms without departing from the spirit or central characteristics thereof. The present examples and embodiments, therefore, are to be considered in all respects as illustrative and not restrictive, and the invention is not to be limited to the details given herein. Accordingly, while the specific embodiments have been illustrated and described, numerous modifications come to mind without significantly departing from the spirit of the invention. The scope of the invention is therefore intended to be limited solely by the scope of the appended claims.

The invention claimed is:

1. An insulating wall assembly, comprising:

a framework having opposite interior and exterior sides and including a plurality of vertical and horizontal support studs defining an inner spacing within the framework, at least two of the vertical and horizontal support studs having an outer stud member with a thickness t1 and an inner stud member with a thickness t2 thinner than the thickness t1 and mounted inwardly to the outer stud member, the outer stud members exceeding the inner stud members on the interior side;

at least one substantially rigid insulating panel mounted to the framework, supported peripherally by the inner stud members; and an insulating material layer extending in the inner spacing and superposed to the at least one rigid insulating panel along a majority of the insulating wall assembly, the outer stud members exceeding inwardly past the insulating material layer.

2. An insulating wall assembly as claimed in claim 1, wherein the at least one substantially rigid insulating panel covers at least partially the inner stud members, close to the exterior side, and the insulating material layer extends in the inner spacing extends inwardly of the at least one substantially rigid insulating panel.

3. An insulating wall assembly as claimed in claim 1, wherein the framework is substantially rectangular and defined by two horizontal support studs and two vertical support studs extending between the two horizontal support studs and each one of the vertical and horizontal support studs comprises an outer stud member and an inner stud member secured inwardly to the respective outer stud member.

4. An insulating wall assembly as claimed in claim 1, comprising a structural panel superposed inwardly to the insulating material layer and covering the inner stud members, the structural panel being supported by the inner stud members and the outer stud members exceed the structural panel on the interior side of the framework.

5. An insulating wall assembly as claimed in claim 1, wherein the at least one substantially rigid insulating panel has a thickness which substantially corresponds to a length of the outer stud members exceeding the inner stud members on the exterior side and the insulating material layer has a thickness which substantially corresponds to a thickness of the inner stud members.

6. An insulating wall assembly as claimed in claim 5, further comprising at least one of a tar paper layer, an air barrier material layer, and a vapor barrier material layer, the tar paper layer and an air barrier material layer being superposable to the at least one substantially rigid insulating panel, on the exterior side of the framework and the vapor barrier material layer being superposable to the structural panel, on the interior side of the framework.

7. An insulating wall assembly as claimed in claim 1, wherein at least one of the support studs has an elongated groove defined therein filled with insulating material.

8. A method for erecting a wall section comprising interconnecting at least two of the insulating wall assembly as claimed in claim 1 in an adjacent configuration.

9. A building comprising at least two of the insulating wall assembly as claimed in claim 1.

10. An insulating wall assembly as claimed in claim 1, wherein the outer stud member extends outwardly of the at least one rigid insulating panel.

11. An insulating wall assembly, comprising:

a framework having opposite interior and exterior sides and including a plurality of vertical and horizontal support studs defining an inner spacing within the framework, at least two of the vertical and horizontal support studs are at least two thickness support studs with an outer portion and an inner portion, the outer portion being thicker than the inner portion and being mounted outwardly to the inner portion;

at least one substantially rigid insulating panel mounted to the framework, supported peripherally by the inner portion of the two thickness support studs;

an insulating material layer extending in the inner spacing and superposed to the at least one rigid insulating panel along a majority of the insulating wall assembly; and a structural panel superposed inwardly to the insulating material layer and covering the inner portion of the support studs, the structural panel being supported by the inner portion of the support studs.

12. An insulating wall assembly as claimed in claim 11, wherein the at least one substantially rigid insulating panel covers at least partially the inner portion of the support studs, close to the exterior side and the insulating material layer extends inwardly of the at least one substantially rigid insulating panel.

13. An insulating wall assembly as claimed in claim 11, wherein the framework is substantially rectangular and defined by two horizontal support studs and two vertical support studs extending between the two horizontal support studs and each one of the vertical and horizontal support studs comprises an outer portion and an inner portion extending inwardly to the respective outer portion.

14. An insulating wall assembly as claimed in claim 11, wherein the outer portion of the support studs exceeds the inner portion of the support studs on the interior side and extends inwardly past the insulating material layer.

15. An insulating wall assembly as claimed in claim 11, wherein the outer portion of the support studs exceeds the structural panel on the interior side of the framework.

16. An insulating wall assembly as claimed in claim 11, wherein the at least one substantially rigid insulating panel has a thickness which substantially corresponds to a length of the outer portion of the support studs exceeding the inner portion of the support studs on the exterior side and the insulating material layer has a thickness which substantially corresponds to a thickness of the inner portion of the support studs.

17. The insulating wall assembly as claimed in claim 11, further comprising at least one of a tar paper layer, an air barrier material layer, and a vapor barrier material layer, the tar paper layer and an air barrier material layer being superposable to the at least one substantially rigid insulating panel, on the exterior side of the framework and the vapor barrier material layer being superposable to the structural panel, on the interior side of the framework.

18. An insulating wall assembly, comprising: a framework including a plurality of support studs defining an inner spacing within the framework, at least one of the support studs having an outer stud member having a thickness t1 and an inner stud member mounted inwardly to the outer stud member and having a thickness t2 thinner than the thickness t1, the outer stud member having at least one elongated groove defined therein and extending along a longitudinal axis of the support stud from an inner face to an outer face of the outer stud member, the at least one elongated groove being filled with a heat insulating material insert.

19. An insulating wall assembly as claimed in claim 18, wherein the inner stud member comprises at least one of the elongated groove in register with the elongated groove defined in the outer stud member.

20. An insulating wall assembly as claimed in claim 18, wherein the outer stud member comprises two members with the insulating material insert extending in-between.

21. An insulating wall assembly as claimed in claim 11, wherein the outer portion of the two thickness support studs extends outwardly of the at least one rigid insulating panel.

22. An insulating wall assembly, comprising:

a framework having opposite interior and exterior sides and including a plurality of vertical and horizontal support studs defining an inner spacing within the framework, at least two of the vertical and horizontal support studs having an outer stud member with a thickness t1 and an inner stud member with a thickness t2 thinner than the thickness t1 and mounted inwardly to the outer stud member, the outer stud member exceeding the inner stud member on the exterior side and the interior side and a length of outer stud members exceeding on the interior side of the framework being longer than a length of outer stud members exceeding on the exterior side of the framework;

at least one substantially rigid insulating panel mounted to the framework, supported peripherally by the inner stud members; and an insulating material layer extending in the inner spacing and superposed to the at least one rigid insulating panel along a majority of the insulating wall assembly.

23. An insulating wall assembly, comprising:

a framework having opposite interior and exterior sides and including a plurality of vertical and horizontal support studs defining an inner spacing within the framework, at least two of the vertical and horizontal support studs are at least two thickness support studs with an outer portion and an inner portion, the outer portion being thicker than the inner portion and being mounted outwardly to the inner portion;

at least one substantially rigid insulating panel mounted to the framework, supported peripherally by the inner portion of the two thickness support studs, and having a thickness which substantially corresponds to a length of the outer portion of the support studs exceeding the inner portion of the support studs on the exterior side; and an insulating material layer extending in the inner spacing, superposed to the at least one rigid insulating panel along a majority of the insulating wall assembly, and having a thickness which substantially corresponds to a thickness of the inner portion of the support studs.

24. An insulating wall assembly, comprising: a framework including a plurality of support studs defining an inner spacing within the framework, at least one of the support studs having an outer stud member having a thickness t1 and an inner stud member mounted inwardly to the outer stud member and having a thickness t2 thinner than the thickness t1, the outer stud member having at least one elongated groove defined therein and extending along a longitudinal axis of the support stud, the at least one elongated groove being filled with a heat insulating material insert, wherein outer stud member comprises two members with the insulating material insert extending in-between.

25. An insulating wall assembly, comprising: a framework including a plurality of support studs defining an inner spacing within the framework, at least one of the support studs having an outer stud member having a thickness t1 and an inner stud member mounted inwardly to the outer stud member and having a thickness t2 thinner than the thickness t1, the outer stud member having at least one elongated groove defined therein and extending partially therethrough from an outer face thereof and along a longitudinal axis of the support stud, the at least one elongated groove being filled with a heat insulating material insert.

26. An insulating wall assembly, comprising:

a framework having opposite interior and exterior sides and including a plurality of vertical and horizontal support studs defining an inner spacing within the framework, at least two of the vertical and horizontal support studs having an outer stud member with a thickness t1 and an inner stud member with a thickness t2 thinner than the thickness t1 and mounted inwardly to the outer stud member;

at least one substantially rigid insulating panel mounted to the framework, supported peripherally by the inner stud members, the outer stud member extending outwardly of the at least one rigid insulating panel; and an insulating material layer extending in the inner spacing and superposed to the at least one rigid insulating panel along a majority of the insulating wall assembly.

27. An insulating wall assembly, comprising:

a framework having opposite interior and exterior sides and including a plurality of vertical and horizontal support studs defining an inner spacing within the framework, at least two of the vertical and horizontal support studs are at least two thickness support studs with an outer portion and an inner portion, the outer portion being thicker than the inner portion and being mounted outwardly to the inner portion;

at least one substantially rigid insulating panel mounted to the framework, supported peripherally by the inner portion of the two thickness support studs, the outer portion of the two thickness support studs extending outwardly of the at least one rigid insulating panel; and an insulating material layer extending in the inner spacing and superposed to the at least one rigid insulating panel along a majority of the insulating wall assembly.

* * * * *